United States Patent [19]

Miyazaki et al.

[11] Patent Number: 5,057,874

[45] Date of Patent: Oct. 15, 1991

[54] PAPER CONVEYING APPARATUS

[75] Inventors: Mikio Miyazaki; Kyoji Kamei; Yoshio Kogure; Masahito Takeshita; Tsutomu Furusawa, all of Kanagawa, Japan

[73] Assignee: Fuji Xerox Co., Ltd., Tokyo, Japan

[21] Appl. No.: 641,802

[22] Filed: Jan. 16, 1991

Related U.S. Application Data

[63] Continuation of Ser. No. 481,992, Feb. 20, 1990, abandoned.

[30] Foreign Application Priority Data

Mar. 3, 1989 [JP] Japan ..... 1-51560

[51] Int. Cl.[5] ..... G03G 21/00

[52] U.S. Cl. ..... 355/316; 355/317

[58] Field of Search ..... 355/316, 317, 318, 311, 355/308, 321; 271/264, 265, 266

[56] References Cited

U.S. PATENT DOCUMENTS

| | | | |
|---|---|---|---|
| 4,015,523 | 4/1977 | Evans et al. | 101/233 |
| 4,473,222 | 9/1984 | Simmons et al. | 271/245 |
| 4,591,144 | 5/1986 | Godlewski | 271/246 |
| 4,597,660 | 7/1986 | Leng et al. | 355/317 |
| 4,669,853 | 6/1987 | Sosinski et al. | 355/317 X |

FOREIGN PATENT DOCUMENTS

| | | |
|---|---|---|
| 0184421 | 6/1986 | European Pat. Off. . |
| 0300095 | 1/1989 | European Pat. Off. . |
| 2074989 | 11/1981 | United Kingdom . |
| 2099406 | 12/1982 | United Kingdom . |
| 2215315 | 9/1989 | United Kingdom . |

*Primary Examiner*—A. T. Grimley
*Assistant Examiner*—Sandra L. Hoffman
*Attorney, Agent, or Firm*—Finnegan, Henderson, Farabow, Garrett, and Dunner

[57] ABSTRACT

A paper feeding apparatus for use in an image forming apparatus which transfers a toner image onto a paper, the paper feeding apparatus comprising paper feed device for feeding paper into a paper feed path, a paper sensor device provided adjacent to the paper feed path for detecting paper on the paper feed path to produce a detection information signal, a control device responsive to the detection information signal from the paper sensor device for controlling movement of the paper wherein the paper is fed into an image transfer portion of the image forming apparatus in proper timing with the operation of an image carrying body of the image forming apparatus and wherein the feeding of paper into the image transfer portion is temporarily stopped until the proper timing occurs with the operation of the image carrying body.

6 Claims, 5 Drawing Sheets

PAPER CONVEYING APPARATUS

This application is a continuation of application Ser. No. 07/481,992 filed Feb. 20, 1990 now abandoned.

BACKGROUND OF THE INVENTION

1. Field of the Invention

The present invention relates to a paper feeding apparatus in an image forming apparatus, such as a copying machine, a printer, or the like, and particularly relates to an apparatus in which a plurality of sheets of paper are simultaneously moved in a paper feed path with less waiting time.

2. Description of the Prior Art

In an image forming apparatus, such as an electronic copying machine using a xerography system, a laser printer, and so on, a toner image is formed on an image carrying body, such as a photosensitive drum. The toner image is next transferred onto paper, and the paper is passed through a means to fix the toner image on the paper. Automatic double-side copying can also be performed by transferring one image onto a back surface of paper after another image has been copied on a front surface of the paper.

In such an automatic double-side copying machine, after transferring a toner image to the surface of paper and fixing the image, the paper is stored in an intermediate tray, and then, the paper is extracted from the intermediate tray and fed to the image transfer portion to copy on the back side of the paper.

Also, in an apparatus such as a laser printer or the like, many different sizes of paper are stored in several paper trays so that paper having a desired size, or having a size corresponding to the size of the original, may be fed out from the paper trays.

In such an apparatus, a control means is generally used so that when a toner image is formed on an image carrying body, paper is fed out from a paper tray in proper timing with the image carrying body.

However, in a large-sized machine, the paper feed path from the paper tray to the image carrying body is comparatively long. There is a problem in that the copy output is slow if paper is fed from the paper tray in synchronization with the image formation on the image carrying body.

Therefore, it is desirable to feed paper not in synchronization with the image formation, but earlier, so that the paper is temporarily stopped in an upstream portion of the feed path in a standby position. The paper is fed to an image transfer position from the standby position in synchronization with the image carrying body.

However, conventional stopping means pushes the front end portion of the paper into a gate member so that the paper is stopped with a curved or buckled surface. Accordingly, a problem arises if the paper remains curved for a long period of time, because the paper tends to retain the curved shape. Trouble may occur in the subsequent feeding of such curved paper.

In an image forming apparatus, such as an automatic double-side copying machine or the like, an intermediate tray to temporarily store paper copied on one side is often used. In order to feed paper copied on one-side to an image transfer portion in such an automatic double-side copying machine, the paper feed path is often longer than the distance between the paper tray and an image transfer portion in an ordinary machine.

Therefore, conventional automatic double-side copying machines require a long time period to prepare a copy. Since a long time period from pushing the start button switch until a copy reaches an output tray is required, the number of copies per unit time is small.

SUMMARY OF THE INVENTION

It is therefore an object of the present invention to solve the foregoing problems in the prior art.

It is another object of the prevent invention to provide an apparatus in which a plurality of sheets of paper can be fed sequentially to an image transfer portion, and in which a plurality of wait stations are provided in a paper feed path such that the paper may be fed sequentially from the wait stations to the image transfer portion in the proper order.

In order to attain the above objects of the present invention, the paper feeding apparatus comprises a paper feed means for feeding paper successively into a paper feed path, a paper sensor means provided midway in the paper feed path for detecting paper on the paper feed path and producing a detection information signal, a control means responsive to the detection information signal from the paper sensor means for controlling movement of the paper so that the paper is fed into the image transfer portion in synchronization with the operation of the image carrying body. If the paper feed timing is not in synchronization with the image carrying body, the control means creates a standby mode.

According to another aspect of the present invention, the paper feeding apparatus comprises a stopping means disposed upstream from an image transfer portion in a paper feed path for temporarily stopping the movement of the paper, the stopping means including a pair of registering rollers disposed upstream of a gate member and a pair of feed rollers disposed downstream of the gate member, each of the pair of registering rollers and the pair of feed rollers being driven by separate driving means, a paper sensor means disposed on an upstream portion of the paper feed path for detecting paper on the paper feed path to produce a detection information signal, and a control means responsive to the detection information signal and a signal relating to the toner image formed on the image carrying body for controlling movement of the paper so as to properly synchronize the operation of the stopping means.

Preferably, the stopping means temporarily stops the paper by nipping the front end portion of the paper with a pair of feed rollers at a position upstream of the gate member. The pair of feed rollers are driven to move the paper against the gate so as to form a curved portion thereon, and the paper is then fed to the pair of registering rollers.

According to a further aspect of the present invention, in an automatic double-side copying machine, the paper feeding apparatus comprises an intermediate tray inserted in a paper feed path, and wait stations for stopping paper in a standby mode disposed at predetermined positions in the paper feed path, the wait stations being arranged so that the paper is stopped in each of the wait stations based on information relating to the formation of an image in the image carrying body. The paper is fed sequentially in order from the wait station closer to the image carrying body.

In the above automatic double-side copying machine, the paper feeding apparatus comprises wait stations located upstream of a toner image transfer means, a paper path reversing means, an intermediate tray, and paper controlling means for controlling paper flow such that unrecorded paper is stopped sequentially in order in the wait stations and is fed sequentially in synchronization with the formation of toner on an image carrying body.

In the image forming apparatus according to the present invention, it is therefore possible to continuously move a plurality of sheets of paper in the paper feed path so that paper may be fed from the image carrying body to the image transfer portion sequentially to increase the paper flow per unit time.

Moreover, in the present invention, it is possible to provide a desired number of wait stations in the paper feed path. It is therefore possible to retain paper in the respective wait stations to prevent the problem caused by succeeding paper running against preceding paper, especially where the succeeding paper is stopped.

Further, since paper stopped upstream of the image carrying body stops without forming a curved portion thereon, the paper does not remain permanently curved even if the stopping time becomes long. This prevents the problem that paper feeding becomes difficult because of permanent curves in the paper.

BRIEF DESCRIPTION OF THE DRAWINGS

The manner by which the above objects, features, and advantages of the present invention are attained will be apparent from the following description when it is considered in view of the drawings, wherein.

DETAILED DESCRIPTION OF THE PREFERRED EMBODIMENTS

Figure 1:
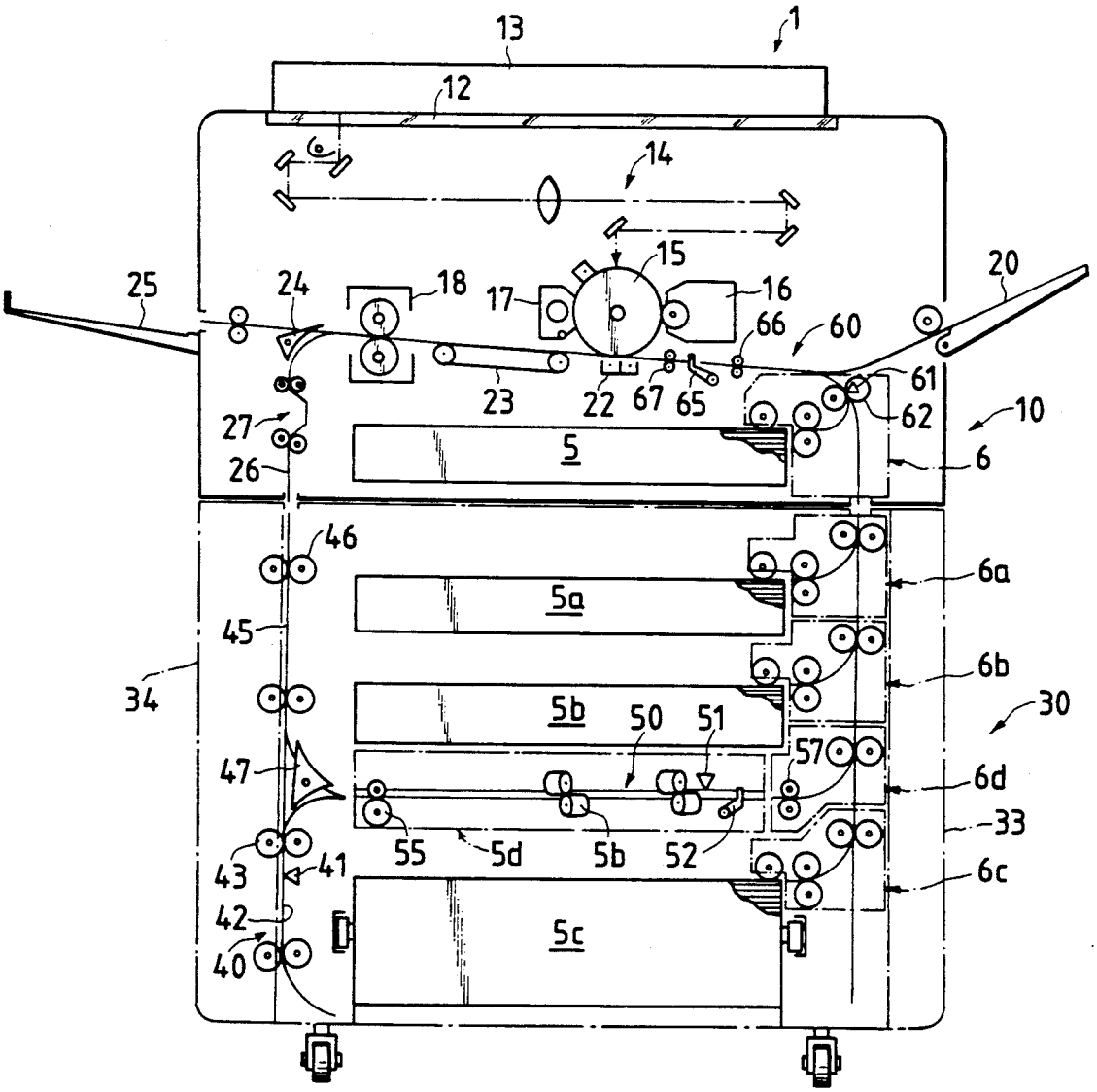
FIG. 1 is a diagram of an electronic copying machine including a paper feeding apparatus according to the present invention.

An image forming apparatus according to the present invention will now be described with reference to the embodiments illustrated in the drawings.

FIG. 1 shows an automatic double-side (duplex) copying machine as an image forming apparatus 1 according to the present invention. The image forming apparatus 1 comprises an upper apparatus portion 10 (e.g., mechanisms of a xerography system), and a lower apparatus portion 30 comprising paper supply units.

In the upper apparatus portion 10 of the image forming apparatus 1 according to the present invention, similar to general copying machines, there is provided a platen 12 disposed at the top of the upper apparatus portion 10, a hinged platen cover 13 disposed above the platen 12 which may be opened toward the upper surface of the platen 12, and a control panel for selecting the various copying functions of the image forming apparatus, such as the number of copies, or other operations.

As shown in FIG. 1, a plurality of paper trays 5 and 5*a* to 5*c* are arranged vertically one on top of the other so that the paper can be easily fed from the paper trays.

The upper apparatus portion 10 further includes an image reader 14, a photosensitive drum 15, various mechanisms of the xerography system disposed around the photosensitive drum 15, the paper tray 5, and a paper feed-out unit 6 disposed adjacent to the paper tray 5.

In the lower apparatus portion 30, there is provided a plurality of paper trays 5*a* through 5*c* arranged vertically, and paper feed-out units 6*a* through 6*c* disposed adjacent to the respective paper trays 5*a* through 5*c*. Each of the paper trays is configured in the form of a front loading tray unit in which the tray unit can be inserted into and removed from the copying apparatus from the front of the apparatus. Paper can be fed out from one side of the paper tray by the corresponding paper feed-out unit.

Further, on opposite sides of the upper and lower apparatus portions 10 and 30, a vertical paper feed path for feeding paper from each paper tray to a recording portion and a vertical return path 45 for feeding copied paper to an intermediate tray located in the lower apparatus portion 30 are provided.

In the lower apparatus portion 30, an intermediate tray 5*d* is disposed between the paper trays. Single-side (simplex) copies can be passed through the intermediate tray 5*d* and fed again into an image transfer portion through a paper feed-out unit 6*d*. Thus, it is possible to select a desired copy mode such as multi-copying, duplex copying, and so on.

In the illustrated embodiment of the present invention, the lowest paper tray 5*c* is configured as a large capacity tray. The large capacity tray is provided on its lower surface with casters for supporting the front end portion of the tray 5*c* when the tray 5*c* is drawn out. The weight of the tray 5*c* is therefore not applied to the frame, as will be described later.

Cover members are provided on the side of the frame. As illustrated in the drawings, side doors 33 and 34 are provided as external covers for the paper feed path. The side doors 33 and 34 are rotatable on hinges provided on the back side of the side doors so that maintenance of the paper supply units may be easily performed. When the side door is opened, it is possible to easily insert a hand into the inside to perform operations such as removal of jammed paper, or the like.

Although the side doors are disposed in the lower apparatus portion 30 in the illustrated embodiment, the side door 33 may also cover the upper apparatus portion 10. Further, shown in FIG. 1, a side cover may be provided on the side of the paper feed-out unit in the upper apparatus portion 10 so that the cover may be opened and closed through hinges provided on lower portions of the side cover.

The side door 34 is provided as a cover member for the return path of paper copied on one-side from the upper apparatus portion 10. Therefore, a branching pawl 47 for diverting paper in the return path into the intermediate tray 5*d* is provided behind the side door 34.

In the above-mentioned copying machine according to the present invention, the side of the upper apparatus portion 10 contains an optical system 14 for scanning an image of an original mounted on the platen 12, a cleaning means 17, a photosensitive drum 15, and a developing means 16 for forming an electrostatic latent image on the photosensitive drum 15 by light transmitted from the optical system 14. The electrostatic latent image is made visible by toner which adheres to the electrostatic latent image to form a toner image.

A paper feed path supplies paper to the image transfer portion of the present invention. For example, paper drawn out of the paper tray 5 is fed by the paper feed-out unit 6, disposed adjacent to the paper tray 5.

After passing through a gate 65 and a front-end positioning means, a toner image on the photosensitive drum 15 is transferred onto the paper when the paper passes between the photosensitive drum 15 and a transfer corotron 22. The paper is then moved by a conveyer 23 into a fixing means 18, which heats and presses the paper to complete the copy. The copy is then discharged to a discharge tray 25 via a discharge path.

Moreover, in the upper apparatus portion 10, a branching pawl 24 is provided in the copy discharge path, so that where multi-copying or double-side copying is selected, the paper is fed to a return path 26 to allow further handling of the paper.

In the lower apparatus portion 30, a plurality of paper trays 5*a* through 5*c* are provided, and the paper feed-out units 6*a* through 6*c* are disposed adjacent to the paper trays 5*a* through 5*c*, respectively, as described above.

The paper feed-out units 6*a* through 6*c* are disposed in one side of the lower apparatus portion 30. Each of the paper feed-out units includes in integral combination, nagger rollers, paper management means, feed rollers acting as a vertical paper feeding mechanism, and so on. Further, each paper feed-out unit is integrally provided with a guide plate that connects the paper feed-out unit to vertically adjacent paper feed-out units.

Through the branching pawl 24, the discharge path of the upper apparatus portion 10 is connected to the return path 45 disposed opposite to the paper feed path in the lower apparatus portion 30. On the return path 45, pairs of feed rollers 46 are disposed at a predetermined interval and are driven in one direction. The portion of the return path 45 lower than the branching pawl 47 constitutes a reverse path 42. In the reverse path 42, pairs of reverse rollers 43 are provided at a predetermined interval and may be driven in either a forward or a reverse direction.

In the usual copying mode, simplex copies passing through the fixing means 18 are discharged directly to the discharge tray 25. On the other hand, in a multi-copying mode or a duplex copying mode, the branching pawl 24 is rotated to guide the paper through a curl correcting means 27, to the return path 26, and to the return path 45 of the lower apparatus portion 30.

In the multi-copying mode, the simplex copy is guided to the intermediate tray 5*d* through the branching pawl 47, and fed to the image transfer portion by the paper supply portion 6*d* through the paper feed path.

In the duplex copy mode, the one-side copied paper is moved from the return path 45 to the reverse path 42. Upon detection that the paper has passed branching pawl 47, the direction of the reverse rollers 43 is switched and the branching pawl 47 is simultaneously rotated so that the paper is guided into the intermediate tray 5*d*. The one-side copied paper is therefore inverted with the proper side oriented to receive an image.

The paper is then positioned in the intermediate tray 5*d* by pairs of oblique feed rollers 56 and a gate 52. The paper is fed out toward the image transfer portion through the paper feed path by a pair of feed rollers 57 of the paper supply unit 6*d* in timing with the formation of an image on the photosensitive drum (or alternatively on the basis of the information indicating that the preceding piece of paper has been moved to the image transfer portion) so that another image is transferred to the back surface of the one-side copied paper.

In the lower apparatus portion 30 according to an embodiment of the present invention, the intermediate tray 5*d* is disposed at a predetermined position by a combination of paper tray units and corresponding paper feed-out units.

As described above, the intermediate tray 5*d* is a tray having a mechanism for feeding out a simplex copy to perform back-surface copying or multi-copying immediately after reception of the simplex copy. However, the intermediate tray 5*d* is not similar to a conventionally known intermediate tray.

In the copying machine according to the present invention, in making a plurality of duplex copies continuously, it is possible to repeat the operation of making simplex copies and the operation of image transfer onto the back surface of the simplex copy by circulating an original in an automatic original feeding means mounted on the copying machine.

Where the intermediate tray is configured similar to a conventional intermediate tray, it is possible to stack sheets of simplex copies paper in the intermediate tray so as to sequentially feed out the sheets for performing the back-surface copying or multi-copying, as described above in a conventional example.

Image Forming Apparatus such as Laser Printer

Figure 2:
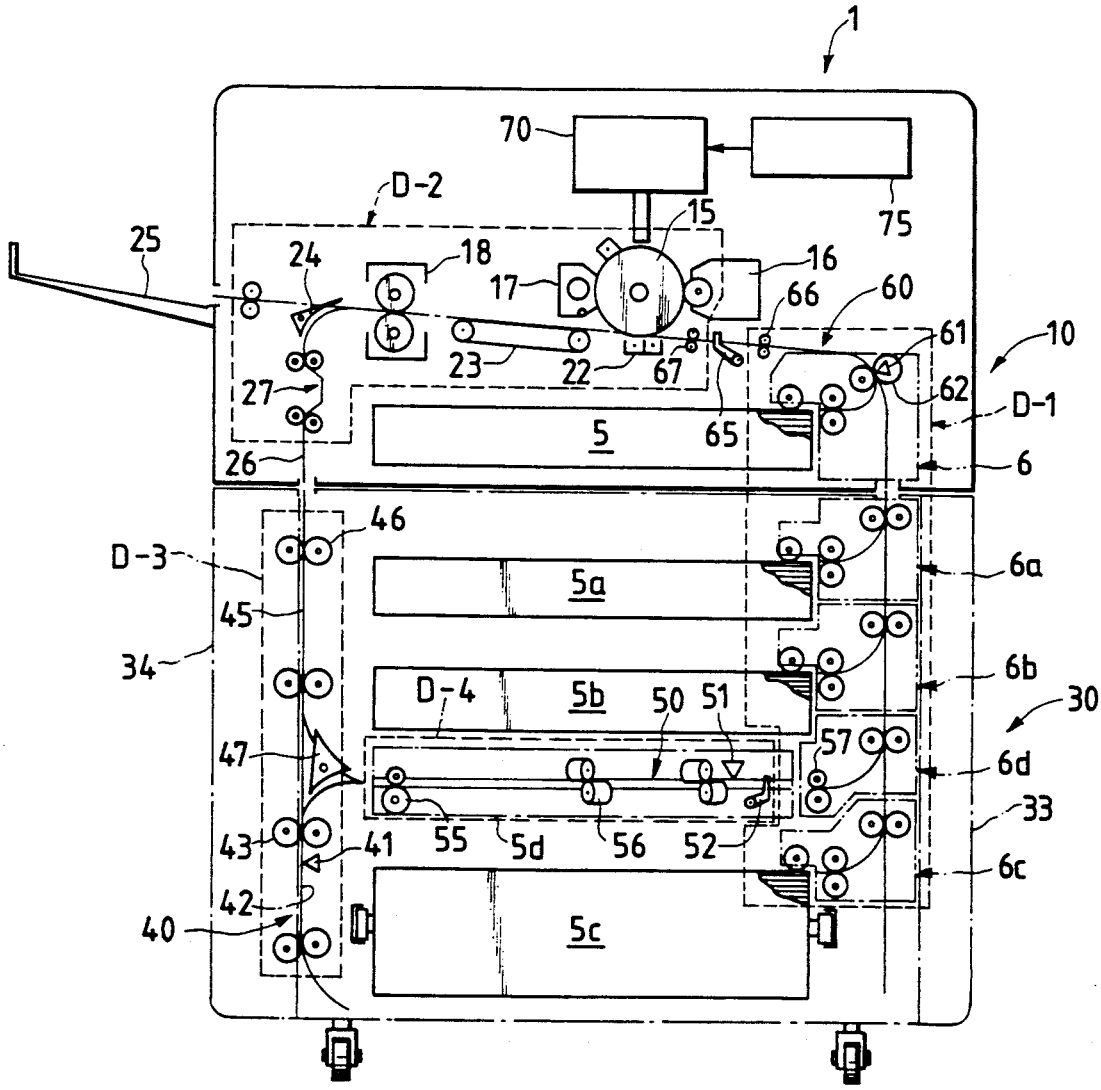
FIG. 2 is a diagram of another embodiment of the paper feeding apparatus of the present invention as used in a laser printer.

An embodiment of the present invention in FIG. 2 illustrates an image forming apparatus 1 configured as a laser printer or the like. A paper feed path and means disposed along the paper feed path, such as paper trays, and an intermediate tray, are configured in the same manner as those in the above-mentioned automatic double-side copying machine. Therefore, the similar components will be not described.

In this embodiment, instead of the optical system in FIG. 1, a writing means 70 using laser light is disposed as means for writing image information onto a photosensitive drum 15. A control means 75 is provided for transmitting image information to the writing means 70.

An image information output means, such as a computer or a micro-computer (not shown), is connected to the control means 75. The writing means 70 operates on information from the image information output means so that the photosensitive drum 15 is irradiated with light from the writing means 70 to form a toner image thereon, which is then transferred onto paper in the same manner as in the ordinary xerography system.

An automatic duplex copying mode may also be selected in a laser printer. Accordingly, an intermediate tray is provided which allows simplex copies to be reversed and fed to an image transfer portion again.

Paper Feed Path Driving System

As shown in FIG. 2, four driving mechanisms D-1 through D-4, such as feed rollers provided on the paper feed path, are provided as driving means.

The driving system D-1 is provided for driving the paper from the paper trays and the intermediate tray to a feed roller means 66 upstream of gate 65. The driving system D-2 is arranged to drive paper downstream of gate 65 within the upper apparatus portion.

Further, the driving system D-3 and D-4 are driven by the same motor. Clutch mechanisms control the feeding means disposed in the vertical feed path, including the return path, and the feeding means disposed in the intermediate tray 5*d*.

In the above-mentioned vertical feed path, the driving mechanism for the return path 45 is provided separately from the driving mechanism for the reverse path 42. It is thus possible to increase the paper feeding speed on the return path so as to prevent a simplex copy form being jammed by succeeding papers when the operation of reversing the copy is performed.

As has been described, by controlling paper feeding at various portions on the paper feed path, it is possible to accurately stop and move paper.

Establishment of Wait Stations

In the present invention, the following wait stations are used to temporarily store blank paper and simplex copies: wait station 40 is provided in reverse path 42, wait station 50 is a portion of the intermediate tray 5*d*, wait station 60 is provided upstream of the photosensitive drum 15 and includes gate 65 acting as a stopping means.

In the wait stations, paper sensors 41, 51 and 61 are disposed for detection of paper. Paper detection signals from paper sensors 41, 51 and 61 are supplied to the control means of the image forming apparatus. The control means directs the movement of paper in the paper feed path on the basis of the paper detection signals, and information relating to the formation of a toner image on the photosensitive drum.

By providing wait stations in the paper feed path, the paper can be stopped in the wait station 60 in proper timing with the toner image formation on the photosensitive drum 15, even when a plurality of sheets of blank paper and simplex copies are simultaneously moved in the paper feed path.

Thereafter, paper is stopped at wait station 50 if paper is stopped wait station 60. Paper is stopped at wait station 40 if a simplex copy is stopped at wait station 50.

When paper is stopped in all wait stations and paper in the wait station 60 is fed to the photosensitive drum, paper will next be fed from the wait station 50, and thereafter paper is fed from the wait station 40.

Because the driving system D-1, D-3 and D-4 are arranged to be driven independently of each other, the paper movement in the wait stations can be controlled. It is therefore possible, even when paper is stopped in all of the wait stations, to feed paper sequentially from the wait stations in accordance with the state of image formation.

Paper Stopping and Feeding Mechanism in Wait Station 60

Figure 3A:
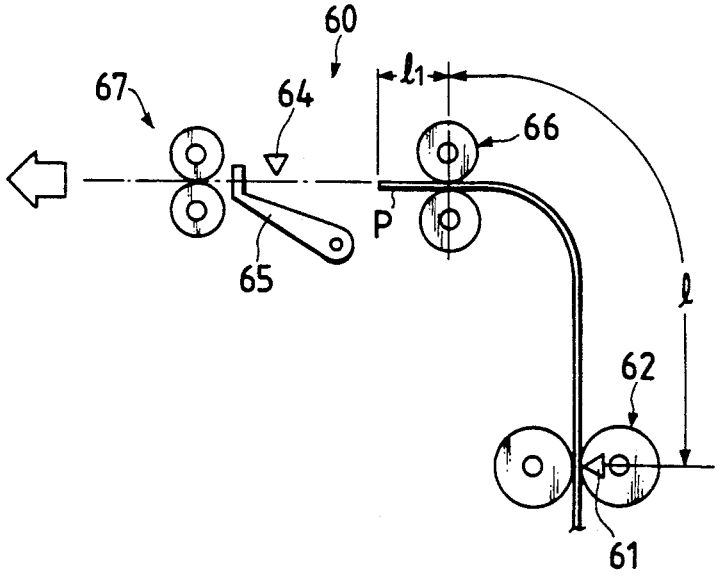
FIGS. 3(*a*), 3(*b*) and 3(*c*) are diagrams of the paper stopping and feeding operations in a wait station illustrating the movement of each piece of paper through the paper feeding apparatus of the present invention.
Figure 3B:
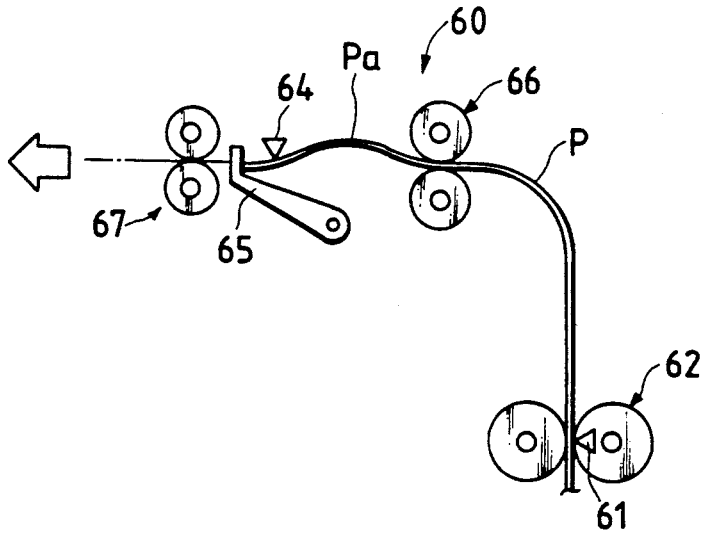
Figure 3C:
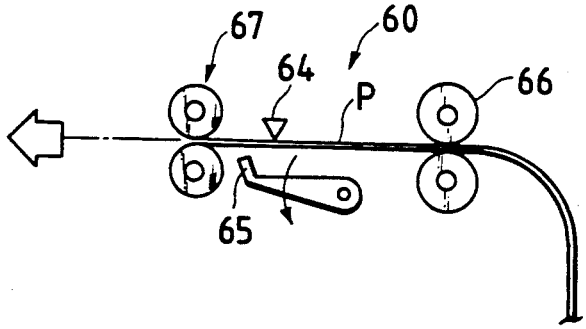

FIG. 3 shows the configuration of a stopping means in the wait station 60 disposed upstream of the photosensitive drum.

In wait station 60, a pair of registration rollers 67 are provided close to the photosensitive drum 15. The gate 65 and the pair of feed rollers 66 are provided upstream of the registration rollers 67. A pair of feed rollers 62 of the paper feed-out unit is disposed upstream of the feed roller means 66 at a predetermined distance.

Moreover, in wait station 60, the paper sensor 61 is provided in a portion of the feed rollers 62 of the paper feed-out unit. A registration sensor 64 is provided slightly upstream of the gate 65.

Upon detection of the front end portion of paper P, the paper sensor 61 supplies a detection information signal to the control means. The control means directs the gate 65 and the rollers in accordance with the state of toner image formation on the photosensitive drum.

When the paper sensor 61 detects the presence of paper and supplies this information to the control means, paper is moved in the paper feed path over a distance l from the paper sensor 61 to the feed rollers 66. Simultaneously, a toner image is formed on the photosensitive drum. Upon completion of the transfer of the toner image to the paper, the front end portion of the paper is positioned by gate 65, and gate 65 is opened so that the paper is fed to the image transfer portion.

However, if the toner image has not been completely formed while the paper P has been moved over the predetermined distance l, as shown in FIG. 3(*a*), the paper P is stopped so that the front end portion thereof is projected over the distance $l_1$ from the nipping portion of the feed rollers 66.

The paper P is fed to the image transfer portion, as shown in FIGS. 3(*b*) and 3(*c*) upon command from the control means.

In other words, in the wait station 60 according to the present invention, the paper P is stopped such that the front end portion thereof is projected over the distance $l_1$ from the feed rollers, and upon generation of a command for moving the paper P, the feed rollers 66 are driven and the gate 65 is projected into the paper feed path.

Then, the front end portion of the paper P is driven by the feed rollers 66 to run against the gate 65 so that a curved portion $P_a$ having a predetermined shape is formed as shown in FIG. 3(*b*). Thereafter, when the gate 65 is opened, the paper P is placed into a nipping portion of the registration rollers 67 by the recoil force of the curved portion of the paper P as shown in FIG. 3(*c*). Paper P then is fed to the image transfer portion by the rollers 67. To control the shape of the curved portion of the paper P, gate 65 is opened by a solenoid after a lapse of a predetermined time from the detection of the paper by the sensor 64.

In other words, where paper is fed out from wait station 60 according to the present invention, the paper is not stopped such that the front end portion of the paper is urged against a registration gate, but is stopped such that it is nipped by feed rollers just before the gate. This differs from a registration means provided in a paper feed path of an ordinary, conventional copying machine.

Therefore, in the present invention, there is no possibility that paper remains curved for an extended period of time, even where the formation of the toner image on an image carrying body is delayed. This prevents the instance where paper permanently retains a curved shape. Accordingly, there is no possibility of trouble in subsequently feeding the paper in the paper feed path.

The present invention is effective particularly where the intervals of outputting image information from a host computer, or the like, to an image forming apparatus, such as a laser printer, or the like, are not fixed.

For example, in the case of a laser printer connected with a computer where outputting of image information is not performed at fixed intervals, there is a problem that the waiting period of paper at a registering position is not fixed as in a copying machine. However, if that paper is handled such that the front end of the paper is nipped by a rollers, as in the apparatus according to the present invention, it is possible to prevent unnecessary curves in the paper.

Operation and Control of Paper Feed Apparatus

Figure 4:
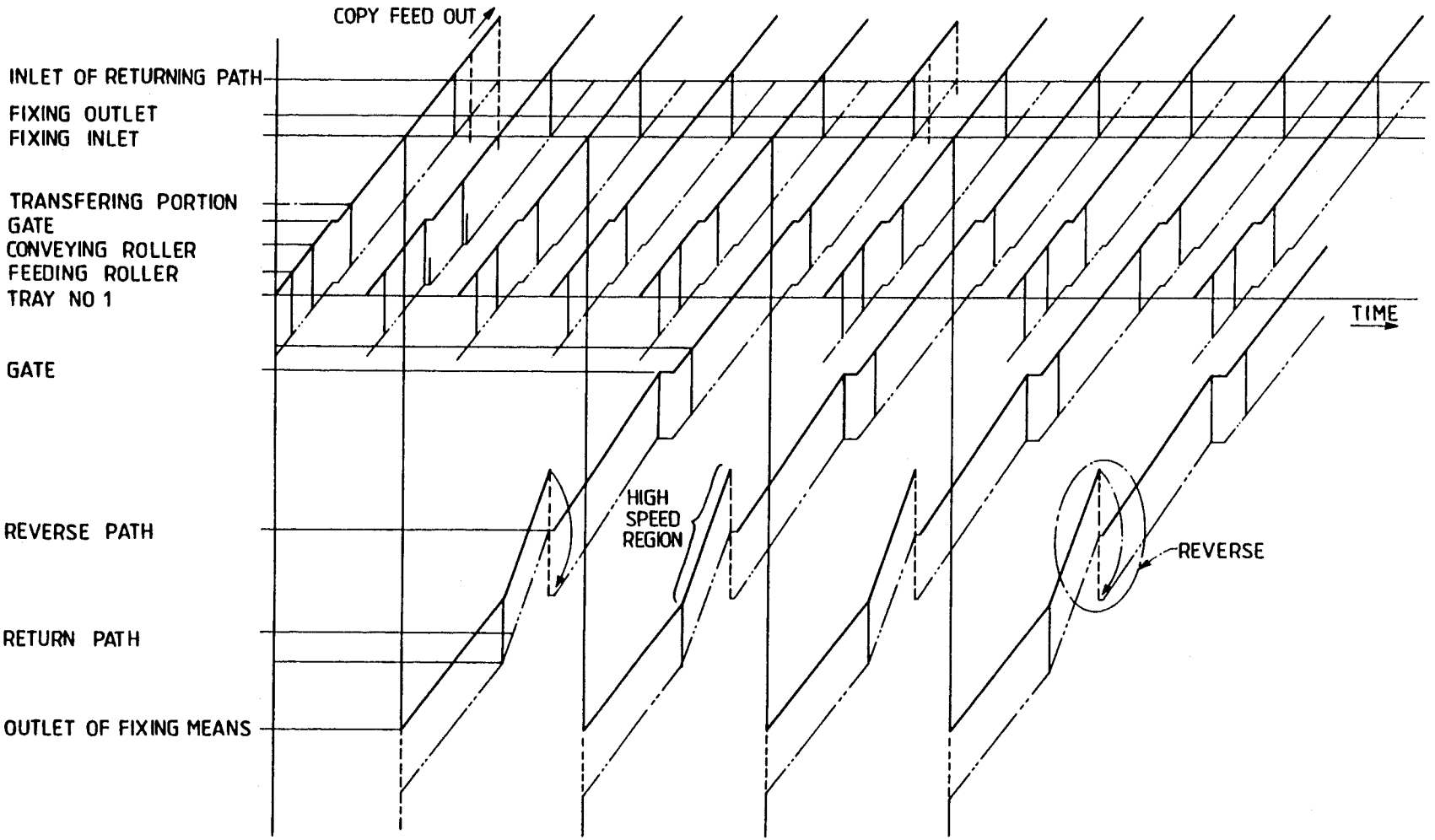
FIG. 4 is a diagram representing the movement of paper in the image forming apparatus of the present invention.

FIG. 4 shows a diagram representing the movement of paper which is periodically fed from the paper tray and a diagram representing the movement of paper which is duplex copied in an automatic double-sided copy mode of the image forming apparatus.

In the image forming apparatus, the first, the third and the fifth pages of recording paper are copied first as shown in FIG. 4. Then, the sheets of paper are supplied alternately from the intermediate tray and the paper tray so that the back and front surfaces are copied sequentially.

Further, in the image forming apparatus, the speed of paper feeding is fixed in the paper feed path, except in the return path. The speed of the return path is increased since paper is moved in forward and backward directions in the return path. In the return path, paper is fed out to the intermediate tray early so that succeeding paper cannot run against the preceding paper.

The making of double-sided copies in the order shown in FIG. 4 is an example where the image forming apparatus has a memory capable of storing 10 pages, and wait stations are established in three portions. However, if those conditions vary, the operation of the apparatus, such as the order of copied pages and so on, varies correspondingly.

In any case, the operation of the wait stations is shown by FIG. 4.

Figure 5:
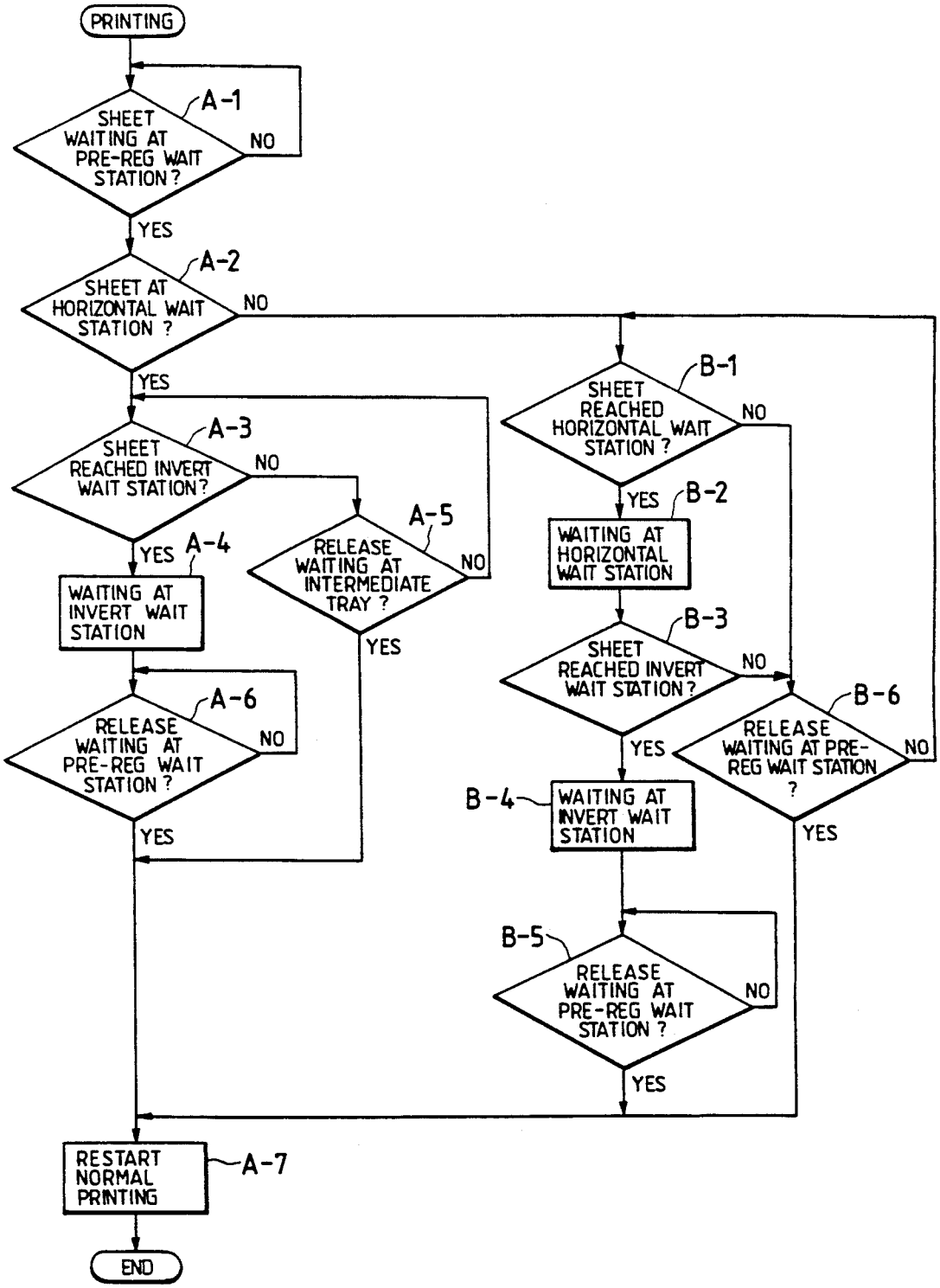
FIG. 5 is a flow chart illustrating the control of paper movement in the paper feeding apparatus of the present invention.

In the image forming apparatus according to the present invention, paper feeding is controlled as shown in the flow chart of FIG. 5. Normally, when paper flows in the paper feed path and a toner images are sequentially formed on the photosensitive drum, control is performed from step A-1 to step A-7. However, if "no" is the answer to the query in step A-2, control is performed along steps B-1 to B-6.

In the flow chart shown of FIG. 5, the steps A-1, A-4, B-2 and B-4 control the stopping of paper in the wait stations. The step A-1 controls the wait station 60 in FIG. 2, the step B-2 controls the wait station 50, and the steps A-4 and B-4 control the wait station 40.

As described above, the movement of paper is controlled on the basis of the paper sensors provided in the paper feed path and a program set in the control means. The program set is chosen, for example, to perform the operation of making up duplex copies sequentially. In addition, the upper stations may be stopped in a predetermined order in accordance with a paper detection signal of lower wait stations. Furthermore, when copies are formed continuously but unperiodically, and at least one of that copies remains in the image forming apparatus, after the image formation, the wait stations may be sequentially stopped in a predetermined order.

In the paper feeding apparatus according to the present invention, a plurality of sheets of paper can be moved in the paper feed path continuously. It is possible to supply paper from the image carrying body to the image transfer portion sequentially, and to increase the number of copies made per unit time.

Moreover, since a desired number of wait stations can be provided in the paper feed path, paper can be stopped in each of the wait stations to prevent succeeding paper from running against the preceding paper, even if the preceding paper is stopped.

Further, since paper stopped upstream of the image carrying body is stopped such that no curved portion is formed in the paper, it is possible to prevent trouble from occurring in feeding the succeeding sheets of paper, even if the waiting time becomes long.

What is claimed is:

1. A paper feeding apparatus for use in an image forming apparatus which transfers a toner image onto a paper, said paper feeding apparatus comprising:
   - paper feed means for feeding paper into a paper feed path;
   - paper sensor means provided adjacent to said paper feed path for detecting paper on said paper feed path to produce a detection information signal;
   - wait station means disposed upstream of an image transfer portion in a paper feed path for temporarily stopping the movement of the paper before the paper reaches a gate member, said wait station means including a pair of feed rollers disposed upstream of said gate member;
   - control means responsive to said detection information signal from said paper sensor means and connected to said wait station means for controlling movement of the paper wherein the paper is fed into said image transfer portion of the image forming apparatus in proper timing with the operation of an image carrying body of the image forming apparatus and wherein the feeding of paper into said image transfer portion is temporarily stopped at said wait station means until the proper timing occurs with the operation of said image carrying body.

2. A paper feeding apparatus for use in an image forming apparatus which transfers a toner image onto a paper, said paper feeding apparatus comprising:
   - wait station means disposed upstream of an image transfer portion in a paper feed path for temporarily stopping the movement of the paper before the paper reaches a gate member, said wait station means including a pair of feed rollers disposed upstream of said gate member;
   - paper sensor means disposed adjacent to said paper feed path for detecting paper in said paper feed path to produce a detection information signal; and
   - control means responsive to said detection information signal and a signal relating to a toner image formed on an image carrying body for controlling movement of the paper wherein said control means causes the paper to standby until said toner image is properly formed on said image carrying body and is suitable for transfer to said paper.

3. A paper feeding apparatus as claimed in claim 2, further comprising means for temporarily stopping said paper with the front end portion of the paper nipped by said pair of feed rollers at the upstream portion of said gate member, means for driving said pair of feed rollers to move the paper against said gate to form a curved portion on said front end portion of said paper, and means for feeding said paper to said pair of registering rollers.

4. A paper feeding apparatus for use in an image forming apparatus which transfers a toner image onto a front or a back side of a paper, said paper feeding apparatus comprising:
   - a plurality of paper feed paths for feeding paper from a paper tray and for circulating paper which has received an incomplete transfer of toner image, said plurality of paper feed paths interconnected via an intermediate tray, said intermediate tray for storing paper which has received an incomplete transfer of toner image; and a plurality of wait stations disposed at predetermined positions in said plurality of paper feed paths for temporarily stopping paper, said plurality of wait stations operating in response to an information signal relating to the formation of a toner image formed in an image carrying body, and said plurality of wait stations feeding said paper sequentially from the wait station closer to said image carrying body, and sequentially in the same order in which said paper was stopped at each wait station.

5. A paper feeding apparatus for use in an image forming apparatus which transfers a toner image onto a front or a back side of a paper, said paper feeding apparatus comprising:

a plurality of paper feed paths for feeding paper from a paper tray and for circulating paper which has received an incomplete transfer of toner image, said plurality of paper feed paths interconnected via an intermediate tray, said intermediate tray for storing paper which has received an incomplete transfer of toner image;

a plurality of wait stations disposed upstream of a toner image transfer portion, a paper reversing path portion, and said intermediate tray, respectively; and control means for controlling the movement of said paper wherein said paper is stopped sequentially in a wait station closer to said image carrying body, and wherein said paper is fed sequentially from a wait station closer to said image carrying body, and sequentially in the same order in which said paper was stopped at each wait station in proper timing with the operation of an image carrying body of the image forming apparatus.

6. A paper feeding apparatus according to claim 5, in which said wait stations are disposed in a reverse feed path, in a portion of an intermediate tray, and in a portion immediately upstream of said image carrying body in said image forming apparatus.

* * * * *